US010720017B1

(12) United States Patent
Lancaster et al.

(10) Patent No.: US 10,720,017 B1
(45) Date of Patent: Jul. 21, 2020

(54) SYSTEMS, METHODS, AND DEVICES FOR A PROGRESSIVE JACKPOT FOR AUTOMATIC TELLER MACHINE (ATM) TRANSACTIONS

(71) Applicant: IGT, Las Vegas, NV (US)

(72) Inventors: Eric Lancaster, Las Vegas, NV (US); Andrew Fisher, Las Vegas, NV (US)

(73) Assignee: IGT, Las Vegas, NV (US)

( * ) Notice: Subject to any disclaimer, the term of this patent is extended or adjusted under 35 U.S.C. 154(b) by 15 days.

(21) Appl. No.: 16/240,118

(22) Filed: Jan. 4, 2019

(51) Int. Cl.
*G07F 17/32* (2006.01)
*G07F 19/00* (2006.01)

(52) U.S. Cl.
CPC ..... *G07F 17/3258* (2013.01); *G07F 17/326* (2013.01); *G07F 17/3211* (2013.01); *G07F 17/3251* (2013.01); *G07F 19/206* (2013.01)

(58) Field of Classification Search
CPC ..... G07F 17/3251; G07F 19/20–201; G07F 19/206; G07F 19/211
See application file for complete search history.

(56) References Cited

U.S. PATENT DOCUMENTS 5,774,884 A * 6/1998 Watanabe ..... G06Q 20/105 705/41
7,052,393 B1 * 5/2006 Schoen ..... G07B 15/02 463/17
7,168,616 B2 * 1/2007 Carnation ..... G06Q 20/105 235/380
7,392,224 B1 * 6/2008 Bauer ..... G06Q 20/04 705/35
7,448,537 B2 * 11/2008 Carnation ..... G06Q 20/10 235/380
9,269,231 B2 2/2016 Curtin et al.
9,824,540 B2 11/2017 Webb
10,068,428 B1 * 9/2018 Eidam ..... G07F 17/329
2003/0064807 A1 * 4/2003 Walker ..... G07F 17/32 463/42
2005/0167488 A1 * 8/2005 Higgins ..... G06Q 20/18 235/381
2006/0213974 A1 * 9/2006 Carnation ..... G06Q 20/105 235/380
2008/0110979 A1 * 5/2008 Carnation ..... G06Q 20/387 235/380
2016/0180647 A1 6/2016 Webb

* cited by examiner

*Primary Examiner* — Steven J Hylinski
(74) *Attorney, Agent, or Firm* — Sage Patent Group

(57) ABSTRACT

An automated teller machine (ATM) server includes a processor circuit and a memory including machine-readable instructions that cause the server processor circuit to, based on receipt transaction request messages, cause a transaction fee to be debited from a credit account that is associated with an account identifier contained in the transaction request message. A portion of the transaction fee is credited to a prize pool for a progressive jackpot, and the ATM server determines when a triggering condition has been satisfied by content of one of the transaction request messages for one of the ATM transactions. When the triggering condition has been satisfied for a particular one of the transaction request messages, an award message is transmitted including an instruction to award a portion of the prize pool to a user associated with the transaction request message.

20 Claims, 5 Drawing Sheets

SYSTEMS, METHODS, AND DEVICES FOR A PROGRESSIVE JACKPOT FOR AUTOMATIC TELLER MACHINE (ATM) TRANSACTIONS

BACKGROUND

Embodiments described herein relate to systems, methods, and devices for automatic teller machine (ATM) transactions, and in particular for providing a progressive jackpot for ATM transactions. ATMs may be commonly located in casinos, among other locations, where a player can withdraw cash. One drawback for a player at a casino withdrawing cash at an ATM is that the ATM often includes a transaction fee for various ATM transactions, such as withdrawing cash from a financial institution, particularly if the financial institution is not affiliated with the ATM. Transaction fees, which may be substantial, may have the effect of discouraging players from withdrawing funds from the ATM at a casino or other property and instead obtain funds in other ways, such as by using casino credit.

BRIEF SUMMARY

According to one embodiment, an automated teller machine (ATM) server is disclosed. The ATM server includes a server processor circuit, and a server memory coupled to the server processor circuit. The server memory includes machine-readable instructions that, when executed by the server processor circuit, cause the server processor circuit to receive transaction request messages for ATM transactions being conducted through ATM devices. The machine-readable instructions further cause the server processing circuit to, based on receipt of each of the transaction request messages, transmit a first debit message including an instruction to debit a transaction fee from a credit account that is associated with an account identifier contained in the transaction request message. The machine-readable instructions further cause the server processing circuit to credit a portion of the transaction fee to a prize pool for a progressive jackpot. The machine-readable instructions further cause the server processing circuit to determine when a triggering condition has been satisfied by content of one of the transaction request messages for one of the ATM transactions. The machine-readable instructions further cause the server processing circuit to, in response to determining that the triggering condition has been satisfied for a particular one of the transaction request messages, transmit an award message including an instruction to award a portion of the prize pool to a user associated with the particular one of the transaction request messages.

According to another embodiment, a method is disclosed. The method includes receiving transaction request messages for ATM transactions being conducted through ATM devices. The method further includes, based on receipt of each of the transaction request messages, transmitting a first debit message including an instruction to debit a transaction fee from a credit account that is associated with an account identifier contained in the transaction request message. The method further includes crediting a portion of the transaction fee to a prize pool for a progressive jackpot. The method further includes determining when a triggering condition has been satisfied by content of one of the transaction request messages for one of the ATM transactions. The method further includes, in response to determining that the triggering condition has been satisfied for a particular one of the transaction request messages, transmitting an award message including an instruction to award a portion of the prize pool to a user associated with the particular one of the transaction request messages.

According to another embodiment, an ATM device is disclosed. The ATM device includes an input device, an electronically controlled dispenser device, a processor circuit, and a memory coupled to the processor circuit. The memory includes machine-readable instructions that, when executed by the processor circuit cause the processor circuit to receive, at the input device, a request from a user to conduct an ATM transaction. The machine-readable instructions further cause the processing circuit to, in response to receiving the request from the user, transmit a transaction request message to an ATM server. The machine-readable instructions further cause the processing circuit to, in response to the ATM server crediting a portion of a transaction fee for the ATM transaction to a prize pool for a progressive jackpot based on the transaction request message and determining that a triggering condition has been satisfied for the transaction request message, receive, from the ATM server, an award message including an instruction to award a portion of the prize pool to a user associated with the transaction request message. The machine-readable instructions further cause the processing circuit to, in response to receiving the award message, dispense, via the electronically controlled dispenser device, a physical item having a monetary value that has been increased based on the portion of the prize pool.

DETAILED DESCRIPTION

Embodiments described herein relate to systems, methods, and devices for automatic teller machine (ATM) transactions, and in particular for providing a progressive jackpot for ATM transactions. In some embodiments, an automated teller machine (ATM) server may cause a transaction fee to be debited from a credit account that is associated with an account identifier contained in the transaction request message. A portion of the transaction fee may be credited to a prize pool for a progressive jackpot, with the ATM server determining when a triggering condition has been satisfied for one of the ATM transactions. When the triggering condition has been satisfied for a particular one of the ATM transactions, a portion of the prize pool may be awarded to a user associated with the transaction request message.

Figure 1:
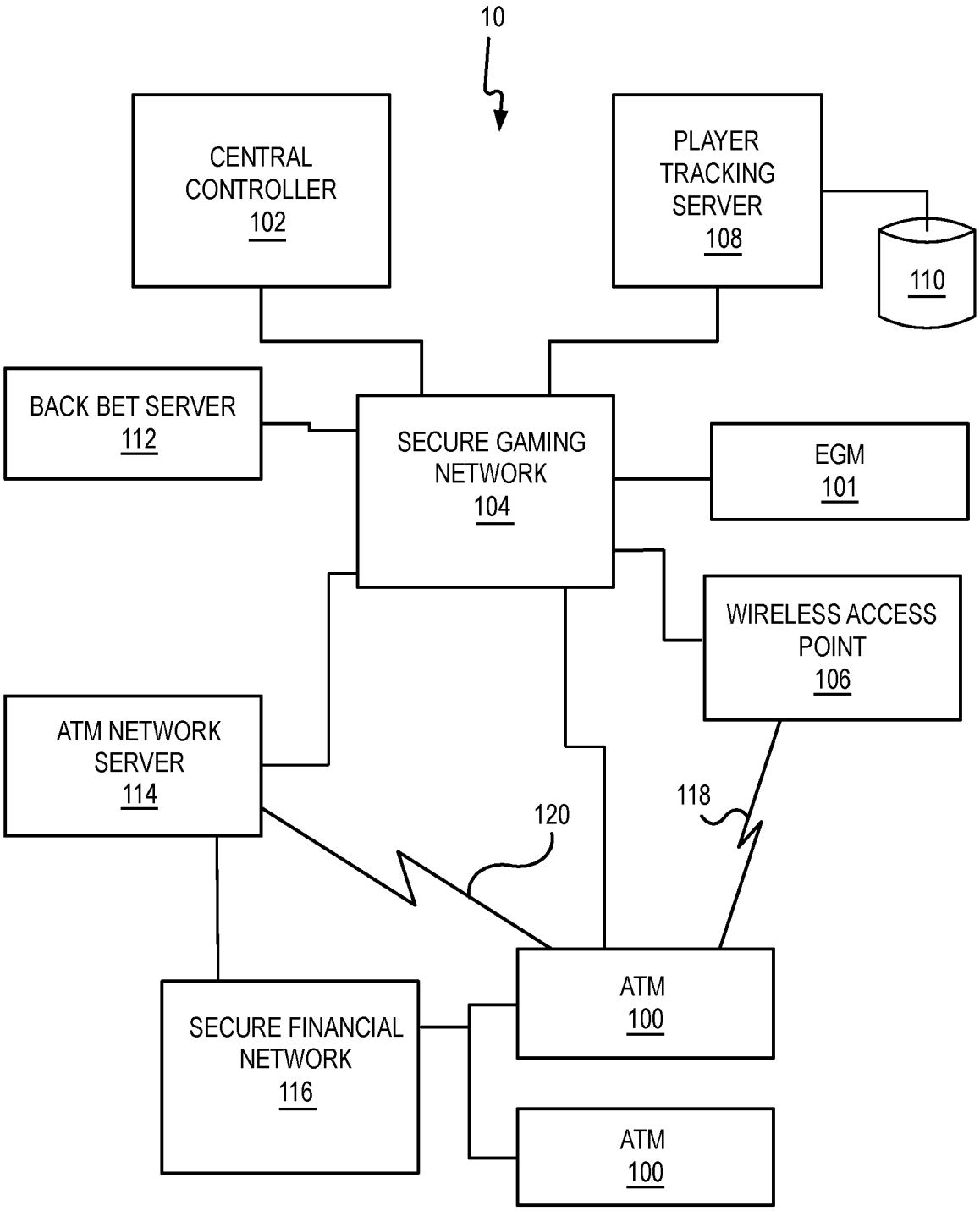
FIG. 1 is a schematic block diagram illustrating a network configuration for a gaming network and financial network including a plurality of automated teller machines (ATMs) according to some embodiments.

Referring now to FIG. 1, an ATM server system 10 including a plurality of automated teller machines (ATMs) 100 is illustrated. The ATM server system 10 may also include a plurality of dedicated electronic gaming machines (EGMs) 101 or other gaming devices, as desired. The system 10 may include a secure gaming network 104 for managing gaming network communications, e.g., communications relating to gaming activity within a casino, and a separate secure financial network 116 for managing communications with outside financial institutions, e.g., communications relating to ATM transactions for ATMs 100 associated with a casino property. Some or all of the components of the system 10, particularly the components associated with the secure gaming network 104, may be located, for example, on the premises of a gaming establishment, such as a casino. Communications on the secure gaming network 104 may be managed by a central controller 102. The secure gaming network 104 may be a private data communication network that is operated, for example, by the gaming facility that operates the EGMs 101 and other gaming devices. Communications over the secure gaming network 104 may be encrypted for security. The central controller 102 may be any suitable server or computing device which includes at least one processor circuit (such as a microprocessor or other processor, for example) and at least one memory or storage device. Each EGM 101 may include a processor circuit that transmits and receives events, messages, commands or any other suitable data or signal between the EGM 101 and the central controller 102. The EGM processor circuit is operable to execute such communicated events, messages or commands in conjunction with the operation of the EGM 101. Moreover, the processor circuit of the central controller 102 is configured to transmit and receive events, messages, commands or any other suitable data or signal between the central controller 102 and each of the individual EGMs 101. In some embodiments, one or more of the functions of the central controller 102 may be performed by one or more EGM processor circuits. Moreover, in some embodiments, one or more of the functions of one or more EGM processor circuits as disclosed herein may be performed by the central controller 102.

A wireless access point 106 may provide wireless access to the secure gaming network 104. The wireless access point 106 may be connected to the secure gaming network 104 as illustrated in FIG. 1, or may be connected directly to the central controller 102 or another server connected to the secure gaming network 104.

A player tracking server 108 may also be connected through the secure gaming network 104. The player tracking server 108 may manage a player tracking account that tracks the player's gameplay and spending and/or other player preferences and customizations, manages loyalty awards for the player, manages funds deposited or advanced on behalf of the player, and other functions. Player information managed by the player tracking server 108 may be stored in a player information database 110. A back bet server 112 may also be provided to manage back bets placed using an EGM 101 or other gaming device.

In this example, an ATM network server 114 manages communications between the ATMs 100 and the secure gaming network 104 and may also manage communications between the ATMs and the secure financial network 116. An ATM 100 may communicate through a wired connection with the secure gaming network 104, via a wireless link 118 between the ATM 100 and the wireless access point 106, and/or via a direct wireless link 120 between the ATM and the ATM network server 114, for example.

The ATM 100 may include a processor circuit that transmits and receives events, messages, commands or any other suitable data or signal between the ATM 100 and the ATM network server 114. The ATM processor circuit is operable to execute such communicated events, messages or commands in conjunction with the operation of the ATM 100. Moreover, the processor circuit of the ATM network server 114 is configured to transmit and receive events, messages, commands or any other suitable data or signal between the central ATM network server 114 and each of the individual ATMs 100. In some embodiments, one or more of the functions of the ATM network server 114 may be performed by one or more ATM processor circuits or other component of the system 10. Moreover, in some embodiments, one or more of the functions of one or more ATM processor circuits as disclosed herein may be performed by the ATM network server 114 or other component of the system 10.

ATMs 100 may be commonly located in casinos, among other locations. Additionally, operators may want to encourage customers withdrawing cash at ATMs 100, as opposed to receiving cash advances or credit form the casino or other methods, because there is no need for the casino to track a player's credit balance or take steps to collect from the player if the player provides his own cash for wagering activity. One drawback for the player withdrawing cash at an ATM 100 is that the ATM 100 often includes a transaction fee for ATM transactions. The fee may often be substantial, and may also be higher for players withdrawing cash from another bank that is not affiliated with the ATM 100. Therefore, it may be desirable for the operator to offer an incentive for players to use ATMs 100 for withdrawing cash at the casino.

In some embodiments, the transaction fee can be structured so that a portion of the transaction fee is credited by the ATM network server 114 to a prize pool for a progressive jackpot. The progressive jackpot may be configured by the ATM network server 114 to pay out in response to the ATM network server 114 determining that a triggering condition has been satisfied. The triggering condition may be based on the prize pool reaching a predetermined and/or a randomly determined threshold amount. Some embodiments provide that the triggering condition may correspond to a predetermined and/or a randomly determined time interval, such as paying out daily, every few days, weekly, and/or every few weeks, for example.

When the triggering condition is satisfied, the ATM network server 114 may cause an award, such as a payout of some or all of the prize pool, to be provided to the ATM user. The award may be provided to the user at the time of the ATM transaction or at some later time. For example, the ATM network server 114 may determine, based on the triggering condition being satisfied, that the next customer that makes a withdrawal from a particular ATM 100, or any of a predetermined plurality of ATMs 100, will be awarded some or all of the prize pool. In this way, these and other embodiments provide a technical solution to the uniquely challenging technical problem of providing funding a progressive jackpot game at a non-gaming device to encourage ATM use at a gaming or other establishment.

As noted above, the system 10, which may be a back office or other server based system, for example, receives data and/or a financial component that is used to fund (e.g. receive coin-in) for the prize pool from the ATM transaction fees. In some embodiments, the transaction fee is fixed, with the user of the ATM qualifying for the progressive jackpot automatically upon paying the transaction fee. In some embodiments, the user may have the option to pay a higher transaction fee, or a separate transaction fee, in exchange for being entered into the progressive jackpot. Entry into the progressive jackpot and/or the size of the transaction fee may be further based on a player status of the user of the ATM. For example, if a player is a member of a casino player's club, the player may be eligible for the award, and/or may have increased odds of winning the award. In some examples, the transaction fee is fixed for all users of the ATM, but the prize pool is only funded by portions of the transaction fees from eligible players. In this manner, coin-in for the progressive jackpot may be received from a non-wagering ATM device and paid to customers who are paying for a non-wagering ATM service, e.g., the withdrawal of cash.

Each ATM 100 may include an identifier, such as a sign, that identifies the ATM 100 as a progressive jackpot ATM. In some embodiments, the sign may include information regarding the current level of the jackpot and/or historical information regarding previous awards. By offering a progressive jackpot feature for ATM transactions, an operator of the ATMs 100 can offer an incentive for users to frequent properties that utilize this feature, including casinos, or to otherwise incentivize user loyalty to a particular ATM operator, such as a particular financial institution or ATM transaction provider.

Figure 2:
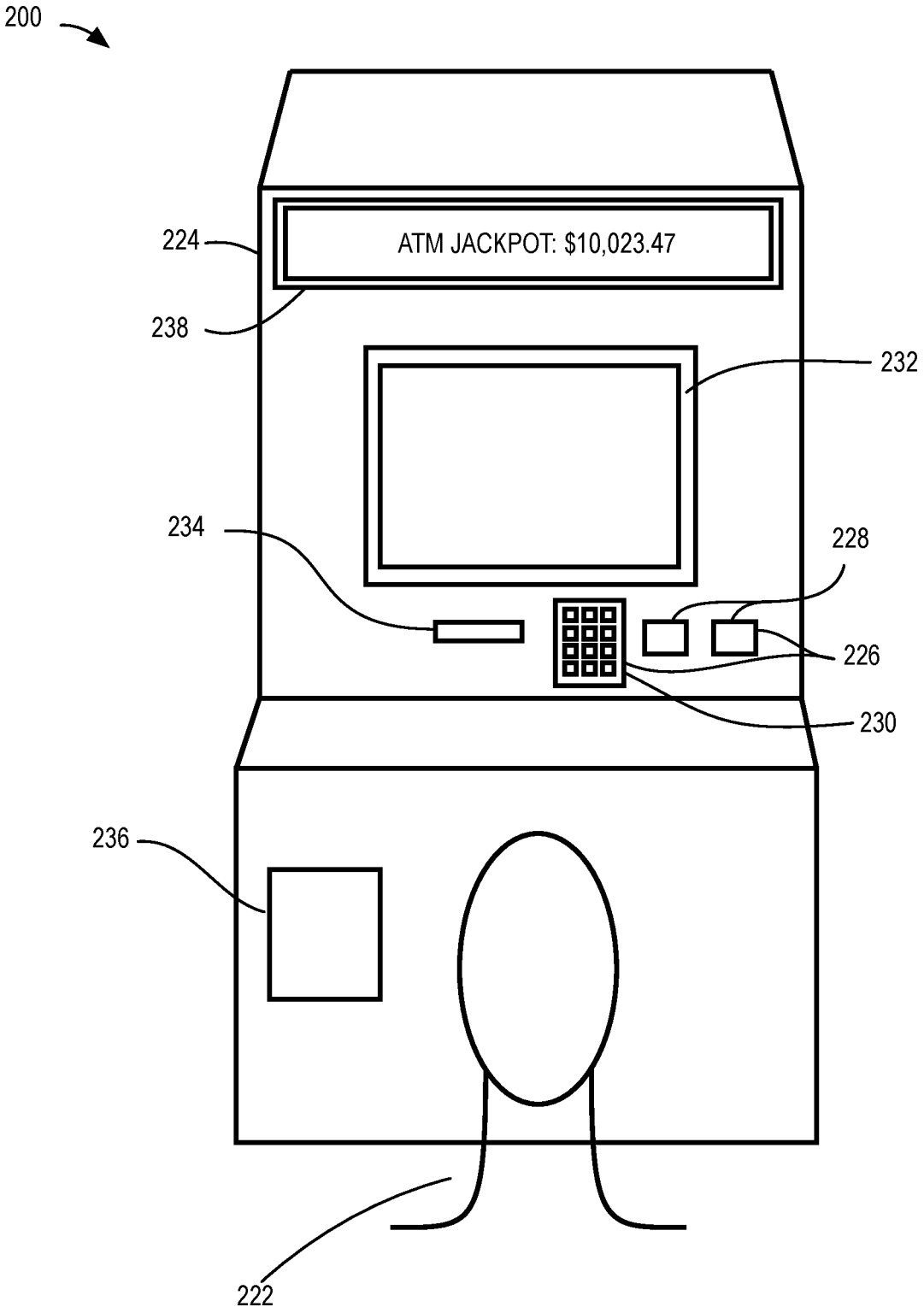
FIG. 2 illustrates an ATM having a progressive jackpot feature according to some embodiments.

Referring now to FIG. 2, an ATM 200 having a progressive jackpot feature is illustrated, according to some embodiments. The ATM 200 may have a housing 224 that may be permanently or semi-permanently installed in a location, e.g., at a predetermined location within a casino, for example. A user 222 of the ATM 200 may interact with the ATM 200 using one or more input devices 226, including buttons 228 and/or a keypad 230 for example, and a display devices 232, which may be a touchscreen display device. The ATM 200 may include an electronically controlled acceptor device 234, such as a card reader and/or a slot for accepting cash, checks, tickets, or other items having monetary or other value. The ATM 200 may also include an electronically controlled dispenser device 236 for dispensing cash, coins, tickets, or other items having monetary or other value. In this example, the electronically controlled acceptor device 234 and the electronically controlled dispenser device 236 are separate components, but it should be understood that, in other embodiments, a single component may perform both functions.

In this example, the display device 232 includes user interface elements, such as a graphical user interface for managing aspects of the ATM transactions and the progressive jackpot. The ATM 200 in this example may also include a secondary display 238 containing a real-time or near-real-time indication of the current size of the prize pool for the progressive jackpot, or other information as desired.

Figure 3A:
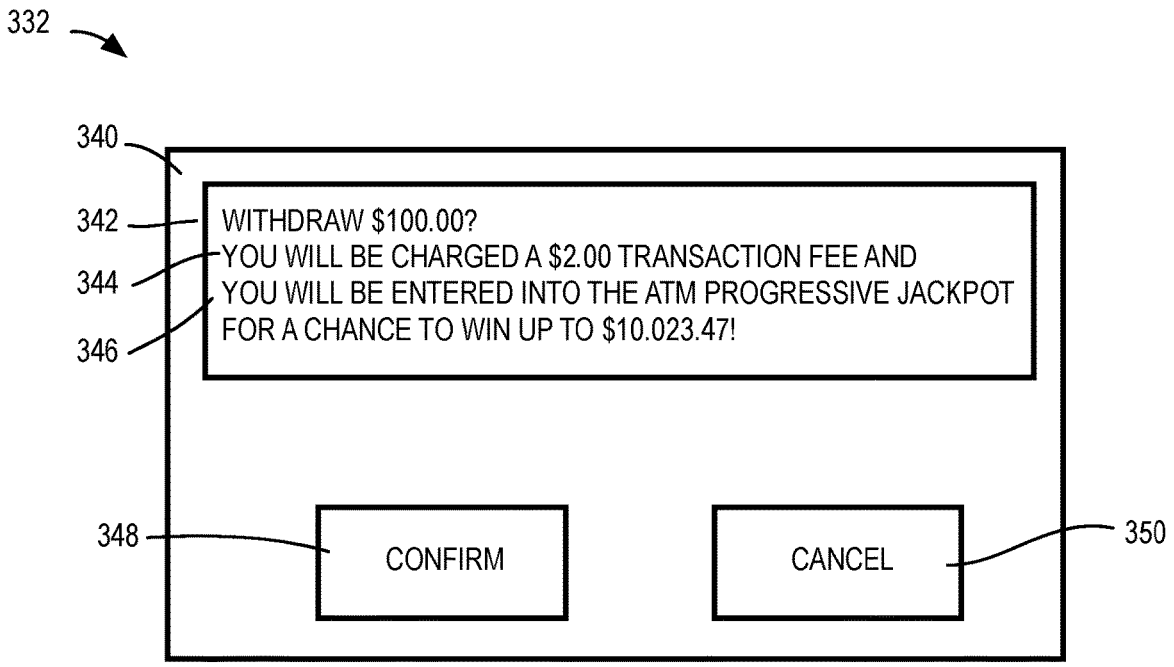
FIGS. 3A and 3B illustrate a graphical user interface (GUI) for providing a progressive jackpot feature at an ATM according to some embodiments.
Figure 3B:
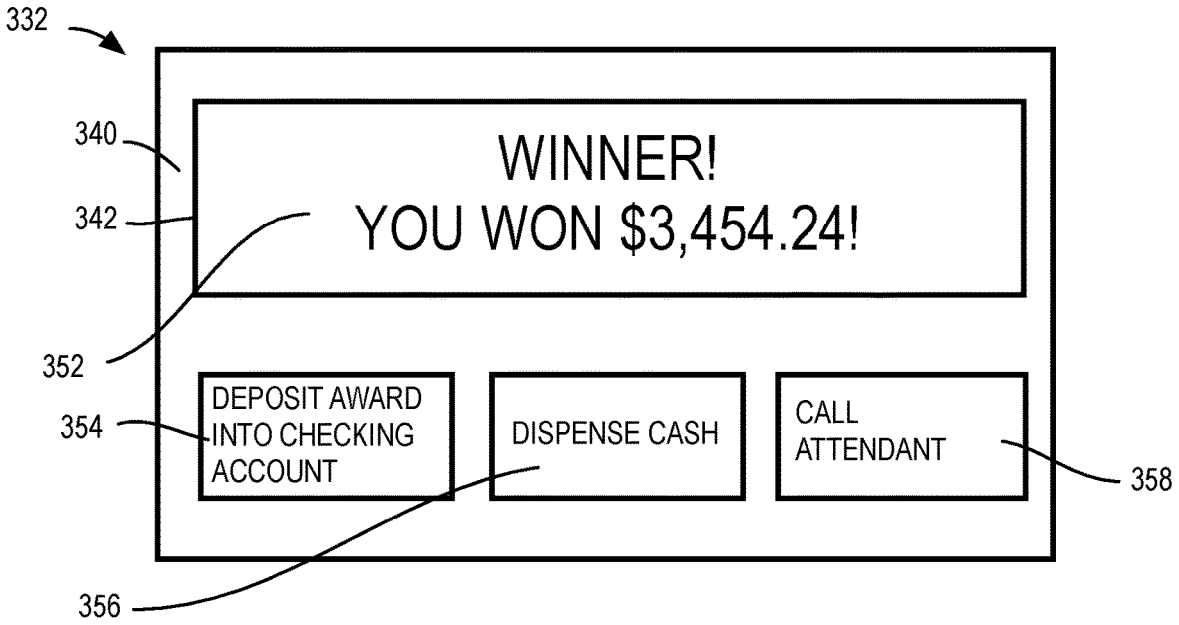

Referring now to FIGS. 3A and 3B, a graphical user interface (GUI) 340 for a managing an ATM transaction and progressive jackpot award is illustrated, according to an embodiment. The GUI 340 of FIG. 3A may include an information display 342, which may include various messages, such as a transaction fee message 344 that notifies a user that the requested ATM transaction will incur a transaction fee, and a progressive jackpot message 346 that notifies a user that the user will be entered into the ATM progressive jackpot. The GUI 340 may also include one or more interface buttons, such as a confirm button 348 to confirm the transaction, authorize payment of the transaction fee and qualify the user for the progressive jackpot, and a cancel button 350 to cancel the transaction and avoid payment of the transaction fee.

Referring now to FIG. 3B, in response to the user winning the progressive jackpot (e.g., by an ATM network determining that a triggering condition has been satisfied), the information display 342 displays an award message 352 to the user indicating that the user has won a portion of the prize pool, and provides one or more options for the user to collect the award. In this example, a deposit button 354 gives the user the option of depositing his winnings in the financial account associated with the original ATM transaction, but it should be understood that the user may also be given the option of depositing the funds into another account. A dispense button 356 may give the user the option to receive the award in cash from the ATM, and a help button 358 may give the user the option of requesting assistance from an attendant, who may be affiliated with the casino for example, who may be able to help the user with collecting the award. In this embodiment, the GUI 340 is displayed on a display 332 of an ATM device, but it should be understood that features of the GUI 340 may be used with other devices in an ATM network system, as desired.

Figure 4:
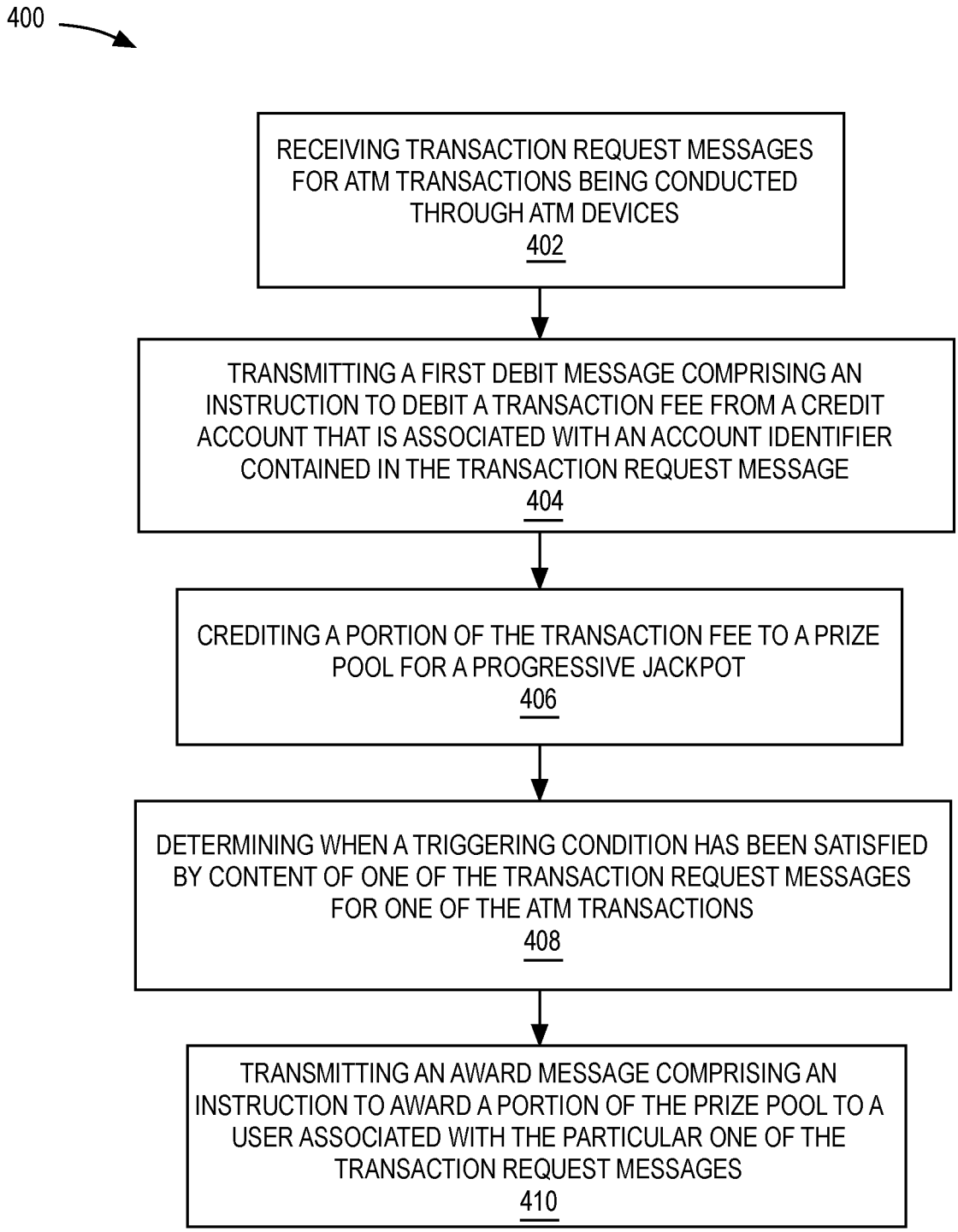
FIG. 4 is a flowchart illustrating operations of systems/methods according to some embodiments.

Referring now to FIG. 4, a flowchart illustrates operations of systems/methods according to some embodiments. The operations 400 include receiving transaction request messages for ATM transactions being conducted through ATM devices (Block 402) and, based on receipt of each of the transaction request messages, transmitting a first debit message including an instruction to debit a transaction fee from a credit account that is associated with an account identifier contained in the transaction request message (Block 404).

The operations 400 next include crediting a portion of the transaction fee to a prize pool for a progressive jackpot (Block 406), and determining when a triggering condition has been satisfied by content of one of the transaction request messages for one of the ATM transactions (Block 408). In some embodiments, for each of the transaction request messages, prior to crediting the portion of the transaction fee to the prize pool, a player status identifier contained in the transaction request message may be determined to be a predetermined player status, with crediting the portion of the transaction fee to the prize pool being performed responsive to determining that the player status identifier is the predetermined player status.

The triggering condition may be determined to be satisfied based on the prize pool being above a predetermined threshold, which may be based on a result generated by a random number generator, and which may be determined before the transaction request messages are received. In some examples, determining that the triggering condition has been satisfied may be based on determining that the player status identifier is the predetermined player status, and based on determining that the prize pool is above a predetermined threshold. In some embodiments, determining that the triggering condition has been satisfied may be based on determining that a player status identifier contained in the particular one of the transaction request messages is a predetermined player status, and based on determining that the prize pool is above a predetermined threshold.

In response to determining that the triggering condition has been satisfied for a particular one of the transaction request messages, the operations 400 include transmitting an award message including an instruction to award a portion of the prize pool to a user associated with the particular one of the transaction request messages (Block 410). The instruction to award the portion of the prize pool to the user may include an instruction to credit the portion of the prize pool to the credit account that is associated with the account identifier contained in the particular one of the transaction request messages. The award message may be directed to a device identifier obtained from the particular one of the transaction request messages for a particular one of the ATM device, with the instruction to award the portion of the prize pool to the user further including an instruction to the particular one of the ATM devices to dispense, via an electronically controlled dispenser apparatus, a physical item having a monetary value that has been increased based on the portion of the prize pool. The instruction to award the portion of the prize pool to the user may also include an instruction to award the entire prize pool to the user.

Figure 5:
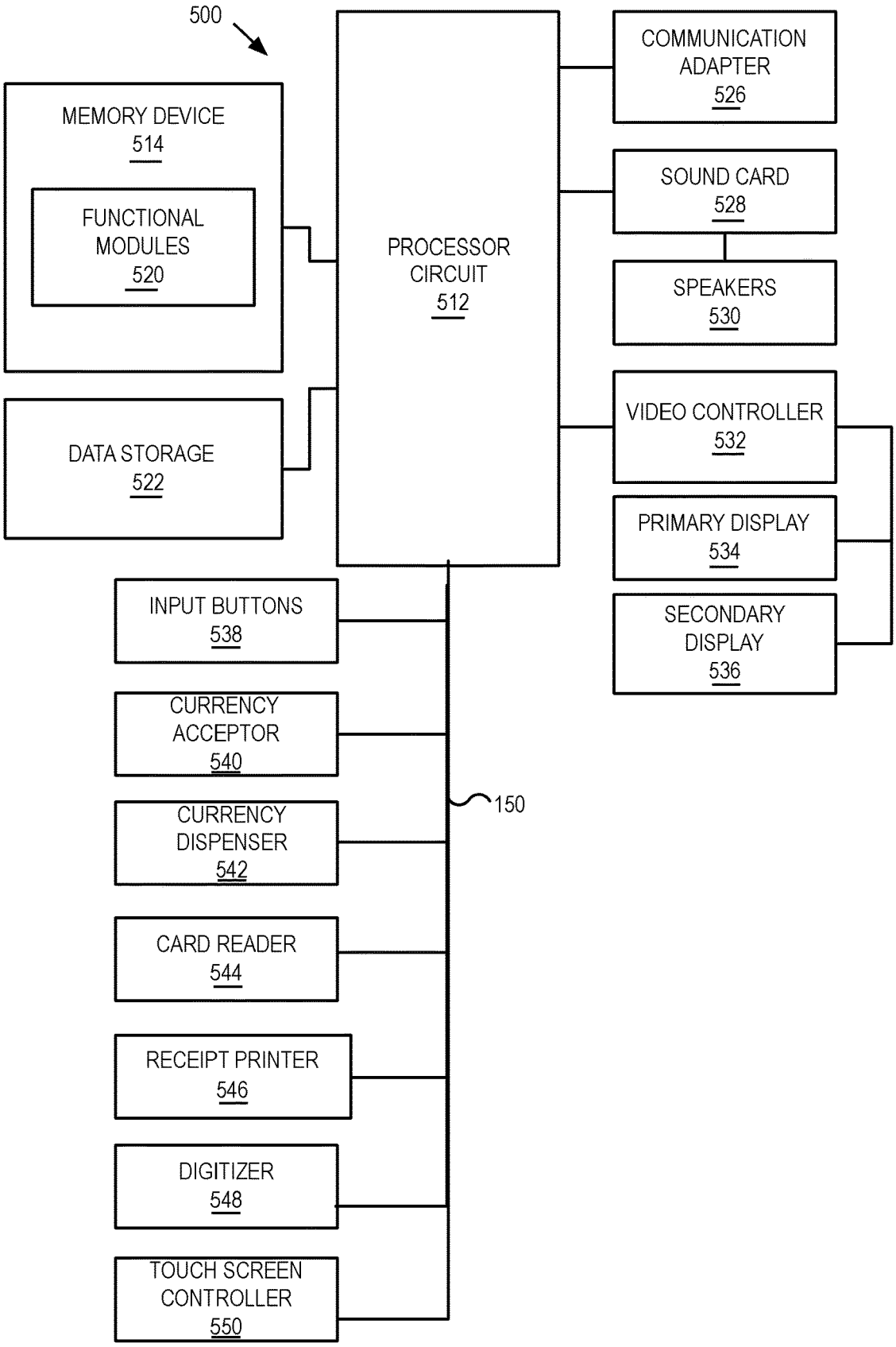
FIG. 5 is a schematic block diagram illustrating an electronic configuration for a computing device according to some embodiments.

ATMs and other components of the systems disclosed herein, such as components of the system 10 of FIG. 1, for example, may include a number of standard features, many of which are illustrated in FIG. 5. For example, referring to FIG. 5, a computing device 500 may be embody or may be a component of a number of the devices discloses herein, including, for example, the ATM network server 114 of FIG. 1, the ATM 100 of FIG. 1, or any number of other embodiments described herein.

In this regard, FIG. 5 is a block diagram of a computing device 500 that illustrates logical and functional relationships between various components of the computing device 500. The computing device 500 may include a processor circuit 512 that controls operations of the computing device 500. Although illustrated as a single processor circuit, multiple special purpose and/or general purpose processors and/or processor cores may be provided in the computing device 500. For example, the computing device 500 may include one or more of a video processor, a signal processor, a sound processor and/or a communication controller that performs one or more control functions within the computing device 500. The processor circuit 512 may be variously referred to as a "controller," "microcontroller," "microprocessor" or simply a "computer." The processor circuit may further include one or more application-specific integrated circuits (ASICs).

Various components of the computing device 500 are illustrated in FIG. 5 as being connected to the processor circuit 512. It will be appreciated that the components may be connected to the processor circuit 512 through a system bus 150, a communication bus and controller, such as a USB controller and USB bus, a network interface, or any other suitable type of connection.

The computing device 500 further includes a memory device 514 that stores one or more functional modules 520. The memory device 514 may store the functional modules 520 and other program code and instructions, executable by the processor circuit 512, to control the computing device 500. The memory device 514 may also store other data such as image data, event data, player input data, random or pseudo-random number generators, pay-table data or information and applicable game rules that relate to the play of the gaming device. The memory device 514 may include random access memory (RAM), which can include non-volatile RAM (NVRAM), magnetic RAM (ARAM), ferro-electric RAM (FeRAM) and other forms as commonly understood in the gaming industry. In some embodiments, the memory device 514 may include read only memory (ROM). In some embodiments, the memory device 514 may include flash memory and/or EEPROM (electrically erasable programmable read only memory). Any other suitable magnetic, optical and/or semiconductor memory may operate in conjunction with the gaming device disclosed herein.

The computing device 500 may further include a data storage device 522, such as a hard disk drive or flash memory. The data storage device 522 may store program data, player data, audit trail data or any other type of data. The data storage device 522 may include a detachable or removable memory device, including, but not limited to, a suitable cartridge, disk, CD ROM, DVD or USB memory device.

The computing device 500 may include a communication adapter 526 that enables the computing device 500 to communicate with remote devices over a wired and/or wireless communication network, such as a local area network (LAN), wide area network (WAN), cellular communication network, or other data communication network. The communication adapter 526 may further include circuitry for supporting short range wireless communication protocols, such as Bluetooth and/or near field communications (NFC) that enable the computing device 500 to communicate, for example, with a mobile communication device operated by a player.

The computing device 500 may include a sound card 528 and speakers 530 for providing audio content and/or feedback to a user, and may include a video controller 532 connected to a primary display 534 and/or a secondary display 536 for providing video content and/or feedback to the user. The computing device 500 may include one or more internal or external communication ports that enable the processor circuit 512 to communicate with and to operate with internal or external peripheral devices, such as input buttons 538, a currency acceptor 540, a currency dispenser 542, a card reader 544, a receipt printer 546, and or other components. A digitizer 548 and/or touch screen controller 550 may enable touchscreen functionality for the primary display 534, secondary display 536, or other displays. Other internal or external peripheral devices may include eye tracking devices, position tracking devices, cameras, accelerometers, arcade sticks, bar code readers, biometric input devices, bonus devices, button panels, card readers, bill and/or coin acceptor/dispensers, coin hoppers, other displays or video sources, expansion buses, information panels, keypads, lights, mass storage devices, microphones, motion sensors, motors, printers, reels, SCSI ports, solenoids, thumb drives, ticket readers, trackballs, touchpads, wheels, and wireless communication devices. In some embodiments, internal or external peripheral devices may communicate with the processor circuit 512 through a universal serial bus (USB) hub (not shown) connected to the processor circuit 512.

In some embodiments, a computing device 500 may be implemented by a desktop computer, a laptop personal computer, a personal digital assistant (PDA), portable computing device, or other computerized platform. In some embodiments, the computing device 500 may be operable over a wireless network, such as part of a wireless gaming system. In such embodiments, the computing device 500 may be a hand held device, a mobile device or any other suitable wireless device. It should also be understood that a computing device 500 as disclosed may include mechanical or electro-mechanical elements. It should be appreciated that a computing device 500 as disclosed herein may be a device that has obtained approval from a regulatory agency, such as a financial regulatory agency or regulatory gaming commission, or may be a device that has not obtained approval from a regulatory agency.

Embodiments described herein may be implemented in various configurations for computing device 500, including but not limited to: (1) a dedicated computing device, wherein the computerized instructions for controlling the device are provided with the device prior to delivery or installation of the device; and (2) a changeable computing device 500, where the computerized instructions for controlling the device are downloadable to the device through a data network where the device is located and/or installed. In some embodiments, the computerized instructions for controlling the device are executed by at least one central server, central controller or remote host. In such a "thin client" embodiment, the central server remotely controls the functions of the device (or other suitable interfaces) and the computing device 500 is utilized to execute such functions (or suitable interfaces) and receive one or more inputs or commands from a user. In another embodiment, the computerized instructions for controlling the device are communicated from the central server, central controller or remote host to a local processor circuit and memory devices. In such a "thick client" embodiment, the local processor circuit executes the communicated computerized instructions to control the functions of the device (or other suitable interfaces) provided to a user.

In some embodiments, one or more computing device 500 in a system may be thin client devices and one or more computing device 500 in the system may be thick client devices. In another embodiment, certain functions of the computing device 500 are implemented in a thin client environment and certain other functions of the computing device 500 are implemented in a thick client environment.

The present disclosure contemplates a variety of different computing systems each having one or more of a plurality of different features, attributes, or characteristics. It should be appreciated that a "computing system" as used herein refers to various configurations of: (a) one or more central servers, central controllers, or remote hosts; (b) one or more computing devices; and/or (c) one or more personal computing devices, such as desktop computers, laptop computers, tablet computers or computing devices, personal digital assistants (PDAs), mobile telephones such as smart phones, and other mobile computing devices.

In certain such embodiments, computerized instructions are executed by the central server, central controller, or remote host. In such "thin client" embodiments, the central server, central controller, or remote host remotely controls the certain functionality (or other suitable interfaces) displayed by the computing devices, and the computing device is utilized to display such functionality (or suitable interfaces) and to receive one or more inputs or commands. In other such embodiments, computerized instructions for controlling such functionality displayed by the computing device are communicated from the central server, central controller, or remote host to the computing device and are stored in at least one memory device of the computing device. In such "thin client" embodiments, the at least one processor circuit of the computing device executes the computerized instructions to control any games (or other suitable interfaces) displayed by the computing device.

In some embodiments in which the computing system includes: (a) a computing device configured to communicate with a central server, central controller, or remote host through a data network; and/or (b) a plurality of computing devices configured to communicate with one another through a data network, the data network is an internet or an intranet. In certain such embodiments, an internet browser of the computing device is usable to access an internet page from any location where an internet connection is available. In one such embodiment, after the internet page is accessed, the central server, central controller, or remote host identifies a user prior to enabling that player to use certain functionality of the computing system. In one example, the central server, central controller, or remote host identifies the user by requiring a user account of the user to be logged into via an input of a unique username and password combination assigned to the user. It should be appreciated, however, that the central server, central controller, or remote host may identify the user in any other suitable manner, such as by validating a user tracking identification number associated with the user; by reading a user tracking card or other smart card inserted into a card reader; by validating a unique user identification number associated with the user by the central server, central controller, or remote host; or by identifying the computing device, such as by identifying the MAC address or the IP address of the internet facilitator. In various embodiments, once the central server, central controller, or remote host identifies the user, the central server, central controller, or remote host enables placement of one or more wagers on one or more plays of one or more primary or base games and/or one or more secondary or bonus games, and displays those plays via the internet browser of the computing device.

It should be appreciated that the central server, central controller, or remote host and the computing device are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of computing devices to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product including one or more computer readable media having computer readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any medium that can contain, or store a program for use by or in connection with a machine readable instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor circuit of a general purpose computer, special purpose computer, or other programmable data processing apparatus to produce a machine, such that the instructions, which execute via the processor circuit of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The invention claimed is:

1. An automated teller machine (ATM) server comprising:

a server processor circuit; and a server memory coupled to the server processor circuit, the server memory comprising machine-readable instructions that, when executed by the server processor circuit, cause the server processor circuit to:

receive transaction request messages for ATM transactions being conducted through ATM devices;

based on receipt of each of the transaction request messages, transmit a first debit message comprising an instruction to debit a transaction fee from a credit account that is associated with an account identifier contained in the transaction request message, and credit a portion of the transaction fee to a prize pool for a progressive jackpot;

determine when a triggering condition has been satisfied by content of one of the transaction request messages for one of the ATM transactions; and in response to determining that the triggering condition has been satisfied for a particular one of the transaction request messages, transmit an award message comprising an instruction to award a portion of the prize pool to a user associated with the particular one of the transaction request messages.

2. The ATM server of claim 1, wherein the instruction to award the portion of the prize pool to the user comprises an instruction to credit the portion of the prize pool to the credit account that is associated with the account identifier contained in the particular one of the transaction request messages.

3. The ATM server of claim 1, wherein the award message is directed to a device identifier obtained from the particular one of the transaction request messages for a particular one of the ATM devices, wherein the instruction to award the portion of the prize pool to the user further comprises an instruction to the particular one of the ATM devices to dispense, via an electronically controlled dispenser apparatus, a physical item comprising a monetary value that has been increased based on the portion of the prize pool.

4. The ATM server of claim 1, wherein the instruction to award the portion of the prize pool to the user comprises an instruction to award the entire prize pool to the user.

5. The ATM server of claim 1, wherein the triggering condition is determined to be satisfied based on the prize pool being above a predetermined threshold.

6. The ATM server of claim 5, the server memory further comprising machine-readable instructions that, when executed by the server processor circuit, cause the server processor circuit to determine the predetermined threshold based on a result generated by a random number generator.

7. The ATM server of claim 5, the server memory further comprising machine-readable instructions that, when executed by the server processor circuit, cause the server processor circuit to determine the predetermined threshold before the transaction request messages are received.

8. The ATM server of claim 1, further comprising a plurality of ATM devices in communication with the ATM server, each ATM device comprising:

an input device;

a display device;

a device processor circuit; and a device memory coupled to the device processor circuit, the device memory comprising machine-readable instructions that, when executed by the device processor circuit cause the device processor circuit to:

receive, at the input device, a request to conduct one of the ATM transactions;

in response to receiving the request, transmit one of the transaction request messages to the ATM server, receive, in response to the server processor circuit of the ATM server determining that the triggering condition has been satisfied for the particular one of the transaction request messages from the ATM server and that the one of the transaction request messages is the particular one of the transaction request messages, the award message; and in response to receiving the award message, award the portion of the prize pool to the user associated with the particular one of the transaction request messages.

9. The ATM server of claim 1, the server memory further comprising machine-readable instructions that, when executed by the server processor circuit, cause the server processor circuit to:

for each of the transaction request messages, prior to crediting the portion of the transaction fee to the prize pool, determine whether a player status identifier contained in the transaction request message is a predetermined player status, wherein crediting the portion of the transaction fee to the prize pool is performed responsive to determining that the player status identifier is the predetermined player status.

10. The ATM server of claim 9, the server memory further comprising machine-readable instructions that, when executed by the server processor circuit, cause the server processor circuit to:

determine that the triggering condition has been satisfied based on determining that the player status identifier is the predetermined player status, and based on determining that the prize pool is above a predetermined threshold.

11. The ATM server of claim 1, the server memory further comprising machine-readable instructions that, when executed by the server processor circuit, cause the server processor circuit to:

determine that the triggering condition has been satisfied based on determining that a player status identifier contained in the particular one of the transaction request messages is a predetermined player status, and based on determining that the prize pool is above a predetermined threshold.

12. A method comprising:

receiving transaction request messages for ATM transactions being conducted through ATM devices;

based on receipt of each of the transaction request messages, transmitting a first debit message comprising an instruction to debit a transaction fee from a credit account that is associated with an account identifier contained in the transaction request message, and crediting a portion of the transaction fee to a prize pool for a progressive jackpot;

determining when a triggering condition has been satisfied by content of one of the transaction request messages for one of the ATM transactions; and in response to determining that the triggering condition has been satisfied for a particular one of the transaction request messages, transmitting an award message comprising an instruction to award a portion of the prize pool to a user associated with the particular one of the transaction request messages.

13. The method of claim 12, wherein the instruction to award the portion of the prize pool to the user comprises an instruction to credit the portion of the prize pool to the credit account that is associated with the account identifier contained in the particular one of the transaction request messages.

14. The method of claim 12, wherein the award message is directed to a device identifier obtained from the particular one of the transaction request messages for a particular one of the ATM devices, wherein the instruction to award the portion of the prize pool to the user further comprises an instruction to the particular one of the ATM devices to dispense, via an electronically controlled dispenser apparatus, a physical item comprising a monetary value that has been increased based on the portion of the prize pool.

15. The method of claim 12, wherein the instruction to award the portion of the prize pool to the user comprises an instruction to award the entire prize pool to the user.

16. The method of claim 12, wherein the triggering condition is determined to be satisfied based on the prize pool being above a predetermined threshold.

17. The method of claim 12, further comprising:

for each of the transaction request messages, prior to crediting the portion of the transaction fee to the prize pool, determining whether a player status identifier contained in the transaction request message is a predetermined player status, wherein crediting the portion of the transaction fee to the prize pool is performed responsive to determining that the player status identifier is the predetermined player status.

18. The method of claim 17, further comprising:

determining that the triggering condition has been satisfied based on determining that the player status identifier is the predetermined player status, and based on determining that the prize pool is above a predetermined threshold.

19. The method of claim 12, further comprising:

determining that the triggering condition has been satisfied based on determining that a player status identifier contained in the particular one of the transaction request messages is a predetermined player status, and based on determining that the prize pool is above a predetermined threshold.

20. An automated teller machine (ATM) device comprising:

an input device;

an electronically controlled dispenser device;

a processor circuit; and a memory coupled to the processor circuit, the memory comprising machine-readable instructions that, when executed by the processor circuit cause the processor circuit to:

receive, at the input device, a request from a user to conduct an ATM transaction;

in response to receiving the request from the user, transmit a transaction request message to an ATM server;

in response to the ATM server crediting a portion of a transaction fee for the ATM transaction to a prize pool for a progressive jackpot based on the transaction request message and determining that a triggering condition has been satisfied for the transaction request message, receive, from the ATM server, an award message comprising an instruction to award a portion of the prize pool to a user associated with the transaction request message; and in response to receiving the award message, dispense, via the electronically controlled dispenser device, a physical item comprising a monetary value that has been increased based on the portion of the prize pool.

* * * * *